US010760593B2

(12) United States Patent
Strehle et al.

(10) Patent No.: US 10,760,593 B2
(45) Date of Patent: Sep. 1, 2020

(54) PROTECTIVE GRILLE WITH IMPROVED EFFICIENCY AND NOISE CHARACTERISTICS

(71) Applicant: ebm-papst Mulfingen GmbH & Co. KG, Mulfingen (DE)

(72) Inventors: Michael Strehle, Ingelfingen (DE); Erhard Gruber, Satteldorf (DE); Jens Müller, Künzelsau (DE); Manuel Vogel, Jagsthausen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 198 days.

(21) Appl. No.: 15/517,472

(22) PCT Filed: Aug. 3, 2015

(86) PCT No.: PCT/EP2015/067821
§ 371 (c)(1),
(2) Date: Apr. 6, 2017

(87) PCT Pub. No.: WO2016/071014
PCT Pub. Date: May 12, 2016

(65) Prior Publication Data

US 2017/0306985 A1 Oct. 26, 2017

(30) Foreign Application Priority Data

Nov. 4, 2014 (DE) ..... 10 2014 116 047

(51) Int. Cl.
*F04D 29/70* (2006.01)
*F04D 29/54* (2006.01)
(Continued)

(52) U.S. Cl.
CPC ..... *F04D 29/703* (2013.01); *F04D 29/541* (2013.01); *F24F 13/082* (2013.01); *F04D 19/002* (2013.01); *F24F 2013/088* (2013.01)

(58) Field of Classification Search
CPC ..... F04D 17/165; F04D 19/002; F04D 25/08; F04D 29/4226; F04D 29/541;
(Continued)

(56) References Cited

U.S. PATENT DOCUMENTS 4,657,483 A * 4/1987 Bede ..... F04D 29/545 415/210.1
6,071,079 A 6/2000 Litvin
(Continued)

FOREIGN PATENT DOCUMENTS

DE 102005019421 A1 11/2005
DE 202009017511 U1 5/2011
(Continued)

OTHER PUBLICATIONS

International Search Report (in German with English Translation) for PCT/EP2015/067821, dated Nov. 4, 2015; ISA/EP.

*Primary Examiner* — Charles G Freay
(74) *Attorney, Agent, or Firm* — Harness, Dickey & Pierce, P.L.C.

(57) ABSTRACT

A protective grille for a fan has a web structure which comprises radial webs spaced apart in a circumferential direction and coaxial circumferential webs spaced apart in a radial direction. The protective grille has at least a radial outer region and a central region around a central axis of the protective grille. An envelope surface spanned by the radial outer region and the central region is of convexly curved form in the radial outer region and is of flat form, parallel to a radial plane of the protective grille, in the central region.

9 Claims, 4 Drawing Sheets

Figure 1:
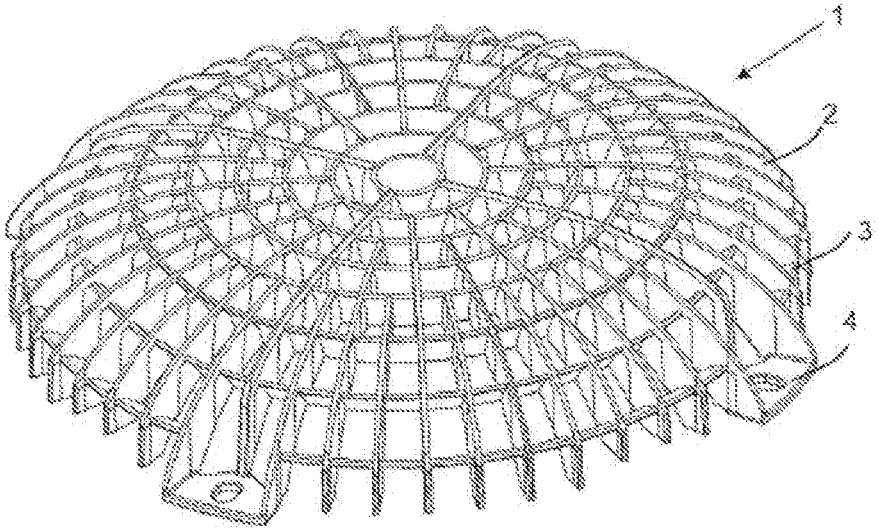

(51) Int. Cl.
*F24F 13/08* (2006.01)
*F04D 19/00* (2006.01)

(58) Field of Classification Search
CPC .... F04D 29/547; F04D 29/703; F24F 13/082; F24F 2013/088
See application file for complete search history.

(56) References Cited

U.S. PATENT DOCUMENTS

| | | | | |
|---|---|---|---|---|
| 6,213,718 | B1 * | 4/2001 | Hill | F04D 29/703 416/146 R |
| 9,097,261 | B2 * | 8/2015 | Haaf | F04D 29/329 |
| 2011/0150632 | A1 | 6/2011 | Heli et al. | |
| 2014/0209275 | A1 * | 7/2014 | Schone | F04D 29/541 165/96 |
| 2015/0104294 | A1 * | 4/2015 | Hustvedt | F04D 29/663 415/119 |

FOREIGN PATENT DOCUMENTS

| | | | |
|---|---|---|---|
| WO | WO-03054395 | A1 | 7/2003 |
| WO | WO-2015124237 | A1 | 8/2015 |

* cited by examiner

PROTECTIVE GRILLE WITH IMPROVED EFFICIENCY AND NOISE CHARACTERISTICS

CROSS REFERENCE TO RELATED APPLICATIONS

This application is a U.S. National Phase Application under 35 U.S.C. 371 of International Application No. PCT/EP2015/067821 filed on Aug. 3, 2015 and published in German as WO 2016/071014 A1 on May 12, 2015. This application claims priority to German Application No. 10 2014 116 047.9 filed on Nov. 4, 2014. The entire disclosures of all of the above applications are incorporated herein by reference.

FIELD

The disclosure relates to a protective grille as a contact safety device for the intake side of fans, for example radial fans or diagonal fans, wherein the protective grille has a flat grille web structure formed from radial webs spaced apart in a circumferential direction and coaxial circumferential webs spaced apart in a radial direction. As the material, customary plastic or metal with relatively thick walls is used, to ensure sufficient stability.

BACKGROUND

What is disadvantageous in the prior art is that when air is admitted through the protective grille, the static overall efficiency of the fan with a protective grille placed on it is impaired, and the noise noticeably increases, especially at higher volume flows.

SUMMARY

It is therefore the object of the disclosure to make available a protective grille for fans, which when attached to fans, ensures improved static overall efficiency and reduced noise as opposed to conventional protective grilles.

According to the disclosure, a protective grille is proposed that is curved three-dimensionally in the axial direction at least in sections, with attachment means for placement on a fan, however, with its axial central area at a farther distance from the fan due to the at least partially convex form, and thus at a distance from the fan wheel. The protective grille has a grille web structure, which in the circumferential direction has spaced radial webs and in the radial direction, spaced coaxial circumferential webs, with the protective grille having at least one radial outer region and a central region about a central axis of the protective grille, an envelope surface spanned from the radial outer region and the central region, convexly curved in the radial outer region and planar in the central region, especially configured parallel to a radial plane of the protective grille.

The arched shape of the protective grille generated by the radial outer region provided with a convex envelope surface increases its strength and stability and makes it possible to design the radial webs and circumferential webs with thinner walls in cross section. By this means, the approaching flow surface of the webs, the flow resistance generated by the webs, and the in turn noise-generating turbulence caused by the webs, is reduced.

In one advantageous embodiment, the radial webs and/or the circumferential webs have a rectangular cross section with a height H and a wall thickness B, the ratio of them being set at $H/B \geq 3$, especially $H/B \geq 3.5$, and further preferred $H/B \geq 4$. With this the side of the radial and circumferential webs that determines wall thickness B has, in a flow direction or opposite the flow direction, which in the central region at least in essence corresponds to an axial direction of the protective grille.

Preferably the protective grille is designed to be rotationally symmetric. In one favorable embodiment version, the central region directly adjoins the radial outer region in the radial direction, with the convexly curved envelope surface of the radial outer region making a smooth transition into the planar central region. This design of the protective grille, free of abrupt transitions, along its envelope surface, likewise promotes strength and stability and enhances the possibility to configure the radial and circumferential webs with thinner walls as described earlier. Alternatively, between the radial axial region and the central region, an intermediate region can be provided, the envelope surface of which has less of a convex curvature as compared to the radial outer region, but nonetheless is not configured to be planar.

What is provided with the disclosure is that the circumferential webs each situated at a radial distance r from the axial center of the protective grille each have a varied angular placement relative to an axial plane of the protective grille. With this, in a favorable embodiment form, the angular placement of the circumferential webs grows greater in the radially outward direction of the protective grille. According to the disclosure, this means that the particular angular placement of the circumferential webs varies in dependence on their distance r to the axial central axis of the protective grille in relation to a maximum distance R of an outermost circumferential web to the axial central axis of the protective grille, and with a distance ratio $r/R=1.0$, an angular placement is set of 50-70°, with a distance ratio $r/R=0.85$, an angular placement of 30-50°, with a distance ratio $r/R=0.70$ an angular displacement of 20-30° and/or with a distance ratio $r/R \leq 0.55$ an angular placement of 0-20° is set vis-à-vis an axial plane of the protective grille. The angle is measured between an extension of the circumferential web along its elevation (height H) and the axial plane of the protective grille. The increasing angular placement of the circumferential webs from the central region in the direction of the radial outer region likewise contributes to noise reduction and improved efficiency of the attached fan.

In yet another favorable embodiment, the radial webs in an axial cross section each have a curved form, and run in an arched shape exhibiting an arch depression to the axial midline of the protective grille.

An additional positive aspect of the disclosure is attained through the special convex-shaped envelope surface in the radial outer region of the protective grille. In one advantageous solution, provision is made that the convexly curved envelope surface in the radial outer region in a lateral cross section determines a partially elliptical contour and is specified in that the ratio of the radial length a of the outer region to the radius c of the protective grille is determined at $a/c>0.25$. From this is produced a radial extension of the radial outer region of at least 25% of the total radius of the protective grille. Additionally an embodiment is preferred in which a ratio of the axial height b of the protective grille to the radius c of the protective grille is determined at $b/c>0.02$. It is further preferred that the ratio of the axial height b of the protective grille to the radius c of the protective grille lie in a range from $0.025 \leq b/c \leq 1$, so that a sufficient axial distance to the attached fan or its fan wheel is ensured, and an optimized protective grille is provided in regard to noise and efficiency.

In regard to the extension and arrangement of the circumferential webs and radial webs of the protective grille, several additional influence parameters have shown to be advantageous for noise development and efficiency. In a first aspect, provision is made that the radial webs extend radially or axially over the outermost of the circumferential webs and form an outer edge of the protective grille, which thus is configured to be open to the flow. Since the protective grille in the outermost radial outer region extends almost exclusively in an axial direction, the main share with an axial extension of the radial webs lies over the radially outermost circumferential web. At the radial outer edge of the protective grille, in one embodiment for, the attachment means are configured in a single piece on the protective grille, to make possible an attachment to the fan via attachment elements customary in prior art.

In an additional aspect, the protective grille is so designed that the number of radial webs in the radial outer region is greater than in the central region, to make the flow resistance in the central area as low as possible. Due to the overall arched shape of the protective grille and the increased axial interval of the central region that goes hand in hand with this, vis-à-vis the attached fan or fan wheel, the mesh width of the grille web structure can there be increased. According to the disclosure this is done by reducing the number of radial webs provided in the central region, i.e., their number drops in the direction of an axial middle of the protective grille.

The disclosure additionally comprises a unit formed from a fan with a protective grille described above, the efficiency of which is improved and noise is reduced.

Other advantageous embodiments of the disclosure are characterized in the subordinate claims and are explained in greater detail in what follows together with the specification of the preferred embodiment of the disclosure, with the aid of the figures.

DRAWINGS

FIG. 1: a perspective view of a protective grille

Figure 2:
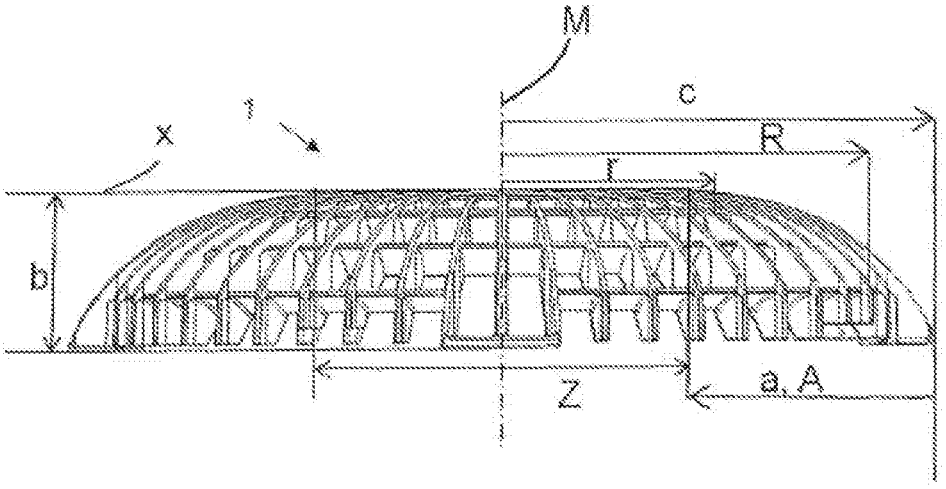

FIG. 2: a side view of the protective grille from FIG. 1

Figure 3:
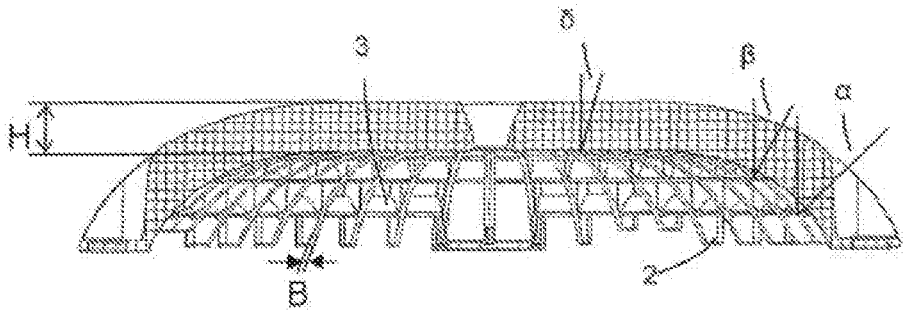

FIG. 3: a side sectional view of the protective grille from FIG. 1

Figure 4:
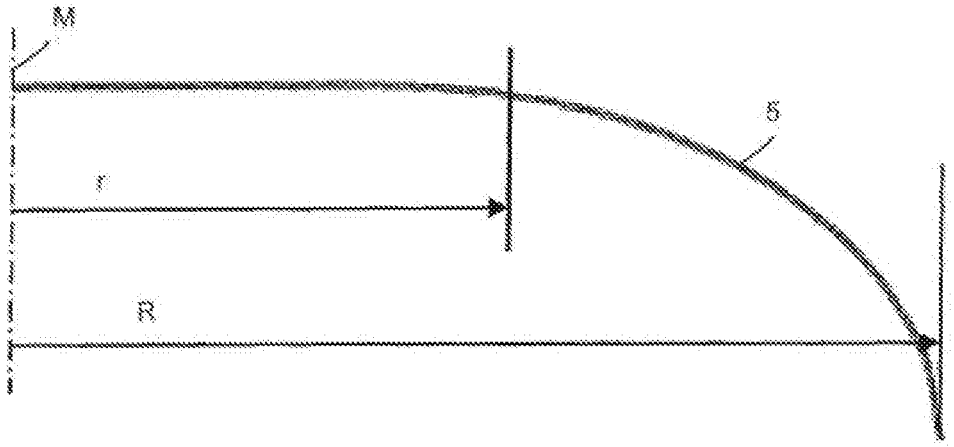
Figure 5:
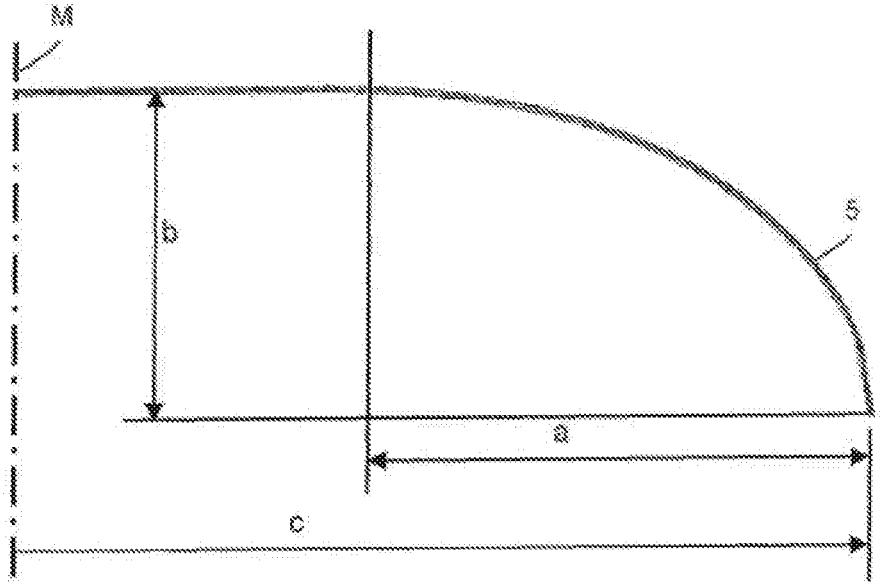
Figure 6:
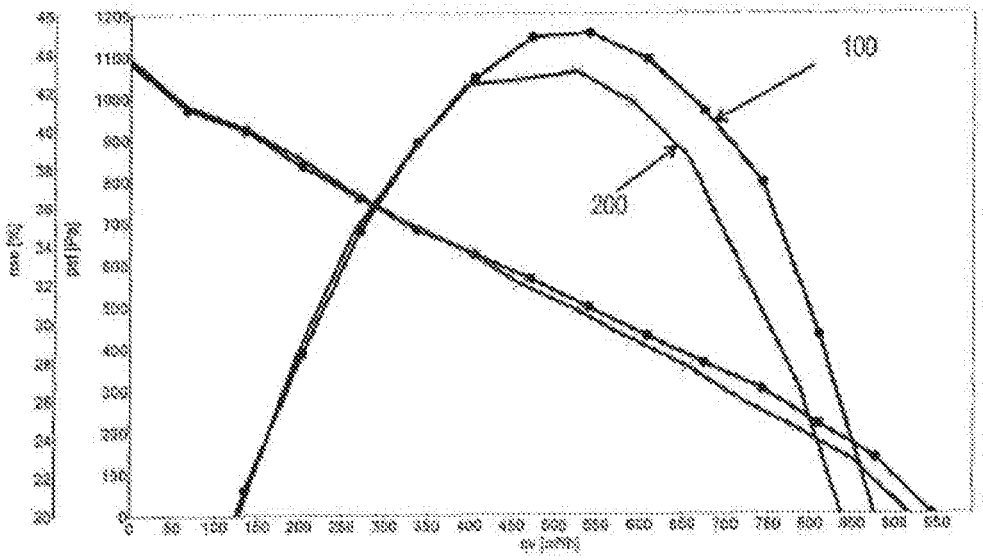
Figure 7:
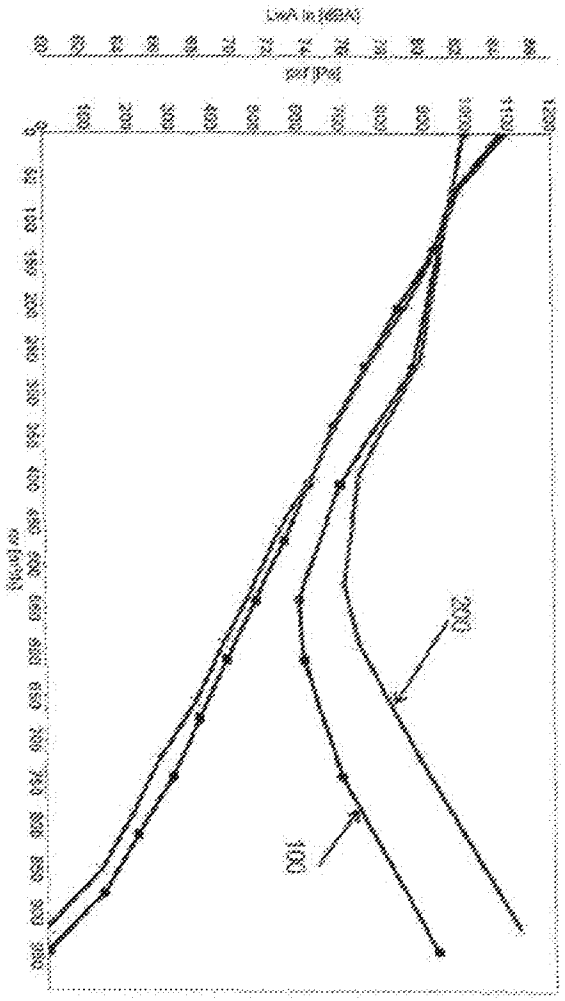

FIG. 4: a lateral depiction of a part of the envelope surface of the protective grille FIG. 5: a lateral depiction of a part of the envelope surface of the protective grille FIG. 6: a characteristic curve comparison of the static efficiency of a fan; and FIG. 7: a characteristic curve comparison of the noise characteristic of a fan.

In the figures, identical reference symbols apply to identical components.

DESCRIPTION

FIG. 1 is an embodiment of a rotationally symmetric protective grille 1 in a perspective view. Protective grille 1 has a grille web structure, formed from radial webs 2 that run spaced apart, intersecting in the circumferential direction, and coaxial circumferential webs 3 that run spaced apart in a radial direction. The radial webs 2 extend radially and axially out over the outermost circumferential web 3 and form an outer edge, running radially in the circumferential direction. On this radial outer edge of protective grille 1, in a single piece four attachment webs 4 are configured, each spaced apart in the circumferential direction at 90 degree angles. The attachment webs 4 are themselves partly formed from radial webs 2.

FIG. 2 shows protective grille 1 from FIG. 1 in a side view. Protective grille 1 has a circumferential radial outer region A and a central region Z around a central axis M. An imaginary envelope surface imaginary spanned from radial outer region A to central region Z is convexly curved in radial outer region A and planar and level in central region Z, so that central region Z extends parallel to a radial plane X of protective grille 1. Central region Z in the radial, inwards direction directly adjoins radial outer region A. The transition is thus a smooth one.

In radial outer region A, the number of radial webs 2 is greater than in central region Z. This is implemented by having radial webs 2 extend to differing lengths in the radial inwards direction and some of them not reaching the radially interior circumferential webs 2. Thus the mesh width in the clear within the grille web structure is greater in central region Z, with the flow resistance simultaneously being lowered thereby.

The plurality of circumferential webs 3 is situated in the radial direction of protective grille 1 each at a radial distance r to the axial center of protective grille 1. For example in FIG. 2 an interval r of the fifth of seven circumferential webs 3 is distinguished based on the central axis M. The distance of radially outermost circumferential web 3 is designated by R. Depending on their distance r to axial central axis M, circumferential webs 3 have a varying angular placement vis-à-vis an axial plane of protective grille 1, wherein in the embodiment shown, with a distance ratio r/R=1.0, (outermost circumferential web) an angular placement is set of $\alpha=60°$, with a distance ratio r/R=0.85, an angular placement of $\beta=40°$, with a distance ratio r/R=0.70 an angular displacement of 30° and/or with a distance ratio r/R 0.55 in central region Z an angular placement $\delta$ of less than 20° is set vis-à-vis an axial plane of protective grille 1.

Combining the view of FIGS. 2 and 4, the convex curved envelope surface of protective grille 1 can be specified in greater detail. In radial outer region A, the convex curved envelope surface in a lateral cross section determines a partially elliptical contour 5, the ratio of the radial length a of radial outer region A of which to radius c of protective grille 1 assumes an example value of about 0.55 in the embodiment shown. Regarding the ratio of the axial height b of protective grille 1 to radius c, in the embodiment shown, an example value of 0.35 is determined. As an example, FIG. 5 shows an alternative embodiment of a partially elliptical contour 5 of the envelope surface with a more pronounced convex arching of radial outer region A and a/c ratios of over 0.6 and b/c of over 0.4.

FIG. 3 is a lateral sectional depiction of the protective grille from FIG. 1 with a cut through a radial web 2. Well perceived is the angular placement of circumferential webs 3. Additionally shown is the thin-walled design of radial webs 2 and circumferential webs 3, wherein the wall thickness B and height H were characterized with the aid of radial webs 2. However, this is correspondingly applicable to the circumferential webs 3. In the cross section both the radial webs 2 and the circumferential webs 3 are right-angled ones. The ratio of wall thickness B to height H is at a value of 5 in the embodiment shown. The thin-walled design of webs 2, 3 is made possible by the shape of protective grille 1.

FIGS. 6 and 7 show diagrams of characteristic line comparisons of the static overall efficiency (FIG. 6) and the sound characteristics (FIG. 7) at various volume flows through protective grille 1 of FIG. 1 and through traditional planar protective grilles. The characteristic curves of disclosure-specific protective grille 1 are designed by 100, and those of the traditional protective grilles by 200. The fan employed is always the same one. According to FIG. 6, the static overall efficiency of disclosure-specific protective grille 1 at a volume flow of 400 $m^3$ per hour continues to rise strongly, and thereby generates a difference of over 2%, which is maintained up to the maximum volume flow. The difference in the noise characteristic is also shown starting at a volume flow of 400 $m^3$ per hour, with disclosure-specific protective grille 1 quieter at maximum volume flow by over 4 dBA than traditional protective grilles. The values measured for disclosure-specific protective grille 1 are on a level with values of fan operation with no protective grille at all.

The disclosure is not limited in its implementation to the preferred embodiments indicated above. Rather, a plurality of variants is conceivable, which also makes use of the depicted solution even with embodiments that are of fundamentally different types. For example, adjoining circumferential webs can also have an identical angular placement. Additionally, the surfaces of webs of the protective grille directed against the flow direction can have a further adapted shape, for example a rounded-off one.

What is claimed is:

1. A protective grille comprising attachment means for placement on a fan, and a grille web structure, which in the circumferential direction has spaced-apart radial webs and in the radial direction has spaced-apart circumferential webs arranged coaxially, the radial webs and/or the circumferential webs have a rectangular cross section, the protective grille at least has a radially outer region and a central region about a central axis of the protective grille, an envelope surface, spanning from the radial outer region to the central region, is configured convexly curved in the radial outer region and planar in the central region, parallel to a radial plane of the protective grille, the convexly curved envelope surface in the radial outer region, in a lateral cross section, determines a partially elliptical contour that has a ratio of a radial length (a), of the outer region, to a radius (c), of the protective grille, of a/c >0.25, and radial web ends terminating independently from one another so that the radial web ends are discrete, unconnected and spaced from one another;

the circumferential webs are each placed in a radial direction at a radial distance r to the axial center of the protective grille and each has a surface positioned on a varied angular position with respect to an axial plane of the protective grille, and the attachment means including a plurality of attachment portions spaced apart in a circumferential direction, the attachment portions partially formed from at least a pair of adjacent radial webs ends so that the attachment portion is formed by an attachment web spanning between, both circumferential and radially, at least the pair of adjacent radial web ends so that the at least a pair of adjacent radial web ends are only directly connected by the attachment web.

2. The protective grille as specified in claim 1, wherein, the protective grille is configured to be rotationally symmetric and the central region, in the radial direction, directly adjoins the radial outer region; and the convexly curved envelope surface of the radial outer region makes a smooth transition into the planar configured central region.

3. The protective grill as specified in claim 1, wherein the angular position of the circumferential webs, independent of their distance r to the axial central axis of the protective grille, varies in relation to a maximum distance R, from an outermost circumferential web to the axial central axis of the protective grille, and with a distance ratio r/R=1.0, an angular placement is provided of 50-70°, with a distance ratio r/R=0.85, an angular placement of 30-50°, with a distance ratio r/R=0.70 an angular placement of 20-30° and/or with a distance ratio r/R 0.55 an angular placement of 0-20° is provided with respect to an axial plane of the protective grille.

4. The protective grille as specified in claim 1, wherein the convexly curved envelope surface in the radial outer region, in a lateral cross section, determines a partially elliptical contour, that has a ratio of an axial height (b) of the protective grille, to a radius (c), of the protective grille, in a range of 0.025 b/c 1.

5. The protective grille as specified in claim 1, wherein the radial webs extend out radially and/or axially over an outermost circumferential web and form an outer edge of the protective grille.

6. The protective grille as specified in claim 1, wherein the number of radial webs in the radially outer region is greater than in the central region.

7. The protective grille as specified in claim 1, wherein the number of radial webs is reduced in a central region of the protective grille relative to the radial outer region.

8. The protective grille as specified in claim 1, wherein the radial webs in an axial cross section have a curved shape.

9. A fan with a protective grille as specified in claim 1.

* * * * *